United States Patent [19]

Mostert

[11] 4,277,050

[45] Jul. 7, 1981

[54] METHOD OF JACKING UP A VEHICLE, AND JACK THEREFOR

[76] Inventor: Jacob J. Mostert, West Krugersdorp, Muldersdrif, South Africa, 1742

[21] Appl. No.: 66,082

[22] Filed: Aug. 13, 1979

[30] Foreign Application Priority Data

Aug. 25, 1978 [ZA] South Africa ..... 78/4857
Nov. 3, 1978 [ZA] South Africa ..... 78/6218

[51] Int. Cl.[3] ..... B66F 7/24
[52] U.S. Cl. ..... 254/94
[58] Field of Search ..... 254/94

[56] References Cited

U.S. PATENT DOCUMENTS

| | | | |
|---|---|---|---|
| 1,057,315 | 3/1913 | Adams | 254/94 |
| 1,604,715 | 2/1927 | Brumfield | 254/94 |
| 1,604,715 | 10/1926 | Patterson | 254/94 |
| 1,961,659 | 6/1934 | Castaneda | 254/94 |
| 1,996,612 | 4/1935 | Cook | 254/94 |
| 1,999,099 | 4/1935 | Hughes | 254/94 |
| 2,056,116 | 9/1936 | Wickliffe | 254/94 |
| 2,059,138 | 10/1936 | Nash et al. | 254/94 |
| 2,367,633 | 1/1945 | Westrate | 254/94 |
| 2,400,780 | 5/1946 | Penner | 254/94 |
| 2,411,803 | 11/1946 | Parrott | 254/94 |

FOREIGN PATENT DOCUMENTS

| | | | |
|---|---|---|---|
| 1200185 | 7/1970 | United Kingdom | 254/94 |
| 1294124 | 10/1972 | United Kingdom | 254/94 |

*Primary Examiner*—Robert C. Watson
*Attorney, Agent, or Firm*—Dressler, Goldsmith, Shore, Sutker & Milnamow, Ltd.

[57] ABSTRACT

A method of jacking up a vehicle having double wheels by means of a jack having a strut passing at a slope into the clearance space between the tires of the double wheels and engaging simultaneously with the bosses of both wheels. The jack also has a base engaging with the ground. Jacking of the vehicle takes place by displacing the vehicle to cause the double wheels to ride up onto the strut in pole vault fashion to lift them clear of the ground.

17 Claims, 6 Drawing Figures

METHOD OF JACKING UP A VEHICLE, AND JACK THEREFOR

This invention relates to a method of jacking up a vehicle and to a jack therefor. It relates in particular to a jack for use with vehicles having double wheels.

Road transport of heavy loads often involves the use of road vehicles having double wheels. It sometimes becomes necessary to jack up such vehicles to remove or to replace the double wheels (e.g. when one of them has become flat). When the vehicle is under load, this can cause great difficulty if conventional jacks only are available. With such jacks, it sometimes becomes necessary to dig holes in the ground in order to obtain sufficient clearance between the truck chassis or axle and the ground.

The double wheels referred to above have an axial clearance space between their tires and rims. The wheels have bosses which are held in abutment along an abutment zone around an axle hub by a plurality of circumferentially spaced securing screws or nuts and studs. The abutting bosses in the abutment zone define a circumferential notch radially outwardly of the abutment zone and of the securing screws or nuts and studs. Vehicles having such double wheels may be in the form of trucks, or in the form of trailers drawn by draft vehicles.

It is an object of this invention to provide a method of jacking up a vehicle having double wheels when under load, which is less difficult than other methods known to the applicant. It is also an object to provide a jack for carrying out the method.

Accordingly the invention provides a method of jacking up of a road vehicle having a pair of double wheels of the kind described, the method including the steps of:

providing a jack comprising a base and a strut adapted to pass into the clearance space between the wheels, the strut having an upper load bearing end;

locating the jack in position such that the base rests against the ground, such that the strut is at a slope in the clearance space between the wheels, and such that the upper load bearing end engages simultaneously with the bosses of both wheels along an engagement zone; and then moving the vehicle against the strut to cause the wheels to ride up onto the strut in pole vault fashion, to lift the wheels clear of the ground.

The load bearing end of the strut may be of concave arcuate shape which seats in the circumferential notch in the abutment zone when the load bearing end of the strut is in engagement with the bosses in the engagement zone.

The arcuate shape of the load bearing end of the strut may converge in cross section towards the end, the bosses then seating in the arcuate shape, and the convergent cross section of the arcuate shape fitting into the notch in the engagement zone. The said load bearing end under load may be adapted to act wedge fashion to part the bosses of the wheels when the securing screws or nuts on the struts are loosened.

If the base is inclined to slip when moving the vehicle against the strut then the base may be temporarily tied to one of the wheels.

In order to have adequate clearance between the ground and the wheels when jacked up, the effective length of the strut may be from 50 to 150 mm longer than the radial distance between the engagement zone and the outer periphery of the wheels.

The base may be detachable from the strut, and may be of ramp formation having an overall height which may be about equal to the length by which the effective length of the strut exceeds the radial distance between the engagement zone and the outer periphery of the wheels.

The invention extends also to a method of removing the double wheels of a road vehicle from an axle hub of the vehicle, which method includes (a) jacking up the wheels according to the method as described;

(b) placing a temporary support under the vehicle at a region in proximity to the said wheels;

(c) loosening the securing screws or nuts to permit the abutting bosses of the wheels to come apart and to pass under gravity on either side of the load bearing end of the strut, thereby permitting the vehicle to rest on the temporary support; and thereafter (d) loosening the wheels from the axle hub and removing them.

The vertical clearance space between the temporary support and the vehicle may be less than the radial spacing between the engagement zone and the securing bolts or studs for holding the wheel bosses.

When the base is detachable from the strut and of ramp formation then the invention extends also to a method of replacing a wheel on an axle hub of a vehicle whose double wheels have been removed, the method including placing the base upside down to form a ramp below the axle hub and then rolling the wheel onto the ramp and when the wheel and axle hub are approximately in alignment, manhandling the wheel onto the axle hub.

The invention also includes a jack which is adapted for use in jacking up a road vehicle having a pair of double wheels of the kind described, the jack comprising;

a base part and strut part extending upwardly from the base part, the strut part having a load bearing end adapted to pass into the axial clearance space between the double wheels and to engage simultaneously along an engagement zone with the abutting bosses of the pair of double wheels, and being adapted to lie at a slope such that the base part engages with the ground.

The strut part and the base part may be separable, and the strut part may have a base end. The base part may have walls defining a socket adapted to accommodate the base end of the strut part. The socket may be rectangular in cross section and may have a length which is at least ten times its thickness.

The invention will now be described by way of example with reference to the accompanying drawings.

Figure 1:
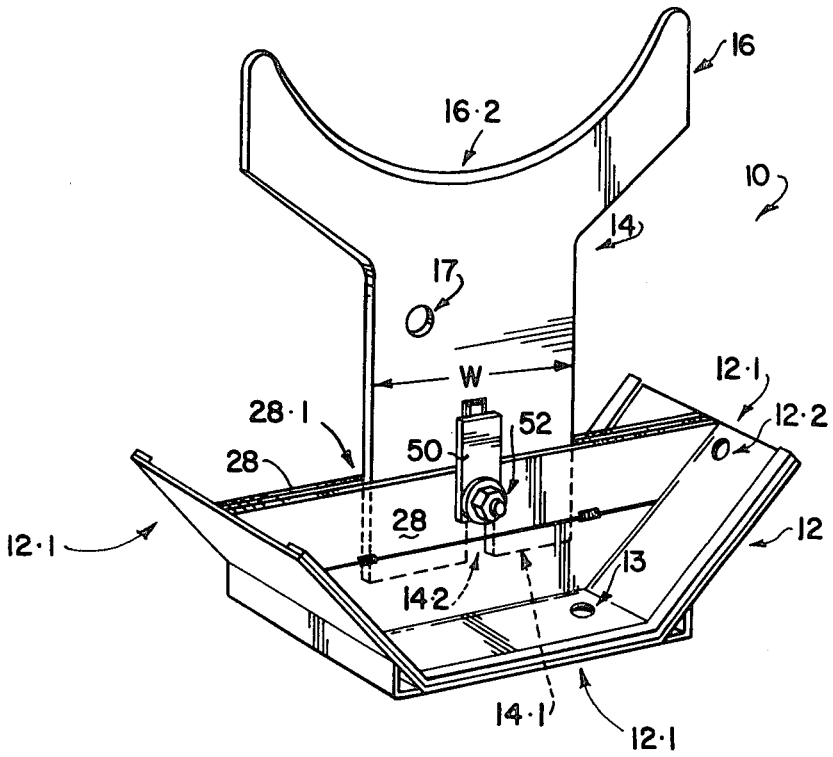
FIG. 1 shows a three dimensional side view of a jack in accordance with the invention.

Referring to the drawings, reference numeral 10 refers generally to a jack comprising a base part 12 and a strut part 14 extending upwardly from the base part 12. The strut part 14 has an upper load bearing end 16 adapted to pass into the axial clearance space 18 between the double wheels 20 of a vehicle. The upper load bearing end 16, is adapted to engage simultaneously along an engagement zone 22 with the abutting bosses 24 and 26 of the double wheels. The strut part, is further adapted to lie at a slope as indicated in FIGS. 2 and 3 so that the base part 12 engages the ground, when the upper load bearing end 16 of the strut part 14 engages with the bosses along the engagement zone 22.

Although the strut part 14 and the base part 12 may be made integrally, they are conveniently made to be separable, the strut part 14 having a base end 14.1. The base part has laterally spaced walls 28, defining a socket 28.1 adapted to accommodate the base end 14.1 of the strut part 14.

The strut part, may be in the form of a plate having a thickness of from 10 to 20 mm, depending upon the load to be carried. The width W of the plate, may conveniently be about 200 mm. The socket has like dimensions, and is of regtangular section. The depth of the socket may be anything from 50 to 150 mm. The depth will be greater, the greater the mass to be lifted by the jack. The strut having a thickness of 10 mm, a width W of 200 mm, and used with a base having a depth of socket of about 100 mm, has been found to be suitable for raising the double wheels of a vehicle capable of carrying up to about 50 tons.

Figure 2:
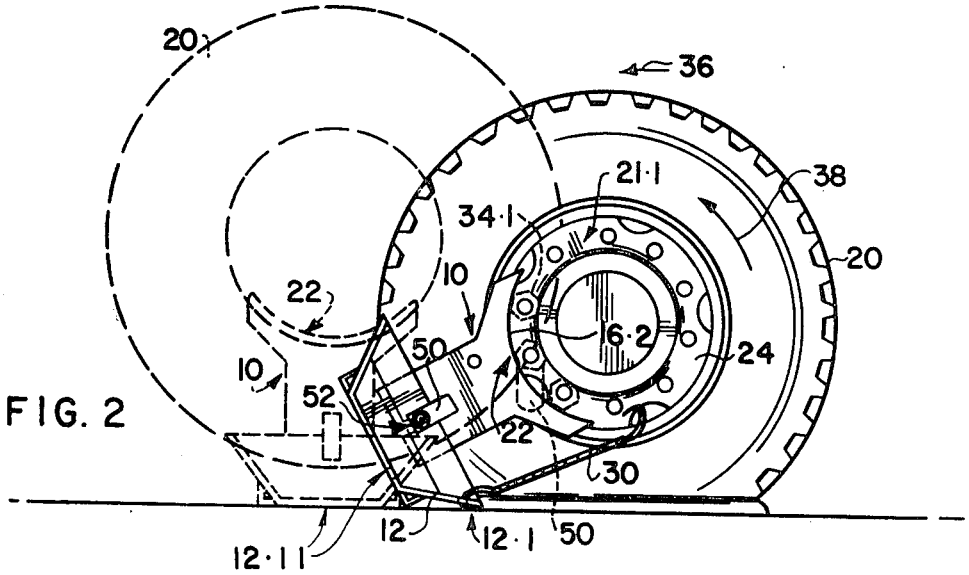
FIG. 2 shows a side view of a jack located in position in relation to a wheel prior to raising, but with one wheel removed for clarity, the position of the wheel and jack being shown in dotted after raising.
Figure 3:
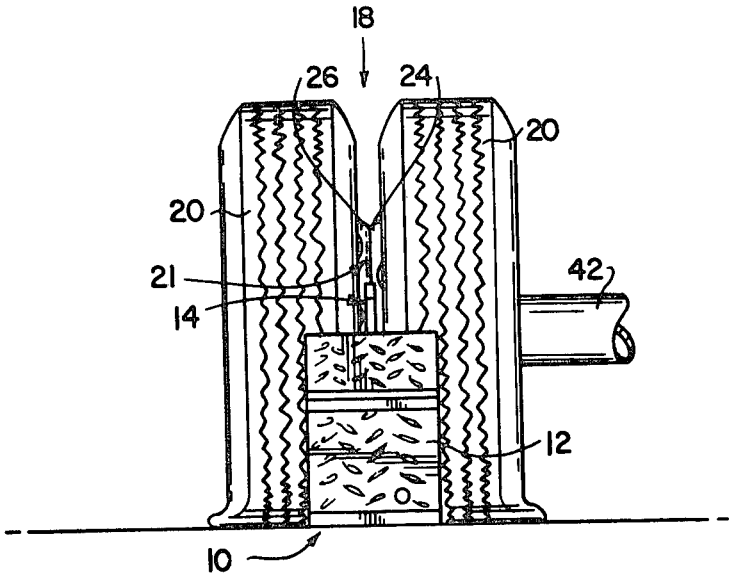
FIG. 3 shows a front view corresponding to FIG. 2 prior to raising.

If the jack has a tendency to move along the ground when the vehicle is being raised, then the one end 12.1 of the base 12, may be tied temporarily by means of a tie 30 in the form of a chain, steel wire rope, or nylon rope, as indicated in FIG. 2, until the wheels have been raised. The tie 30 engages with the opening 12.2 in the sloping end 12.1.

In FIG. 2, one wheel is shown removed, for clarity so as to show the arcuate shape 16.2 in engagement with the engagement zone 22 on the bosses of the wheels. The arcuate shape 16.2 is of convergent cross section towards the centre of curvature, and seats in the circumferential notch 21 in the abutment zone 21.1. (See also FIGS. 3,4, and 5.)

Figure 5:
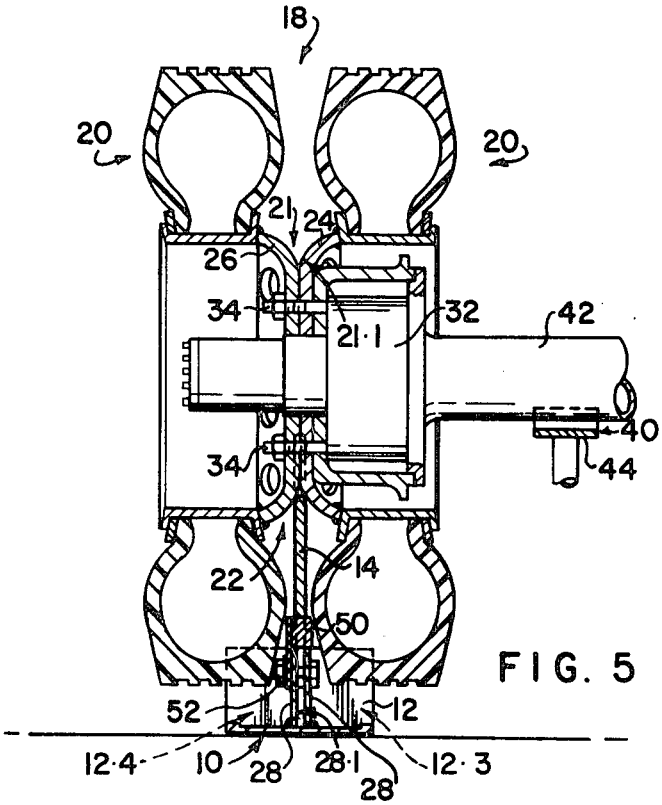
FIG. 5 shows an axial section through a pair of double wheels in the raised position on a jack according to the invention.

As can be seen from FIG. 5 of the drawings, the bosses 24 and 26 are held onto the axle hub 32 of the vehicle, by means of studs 34 and nuts.

Figure 4:
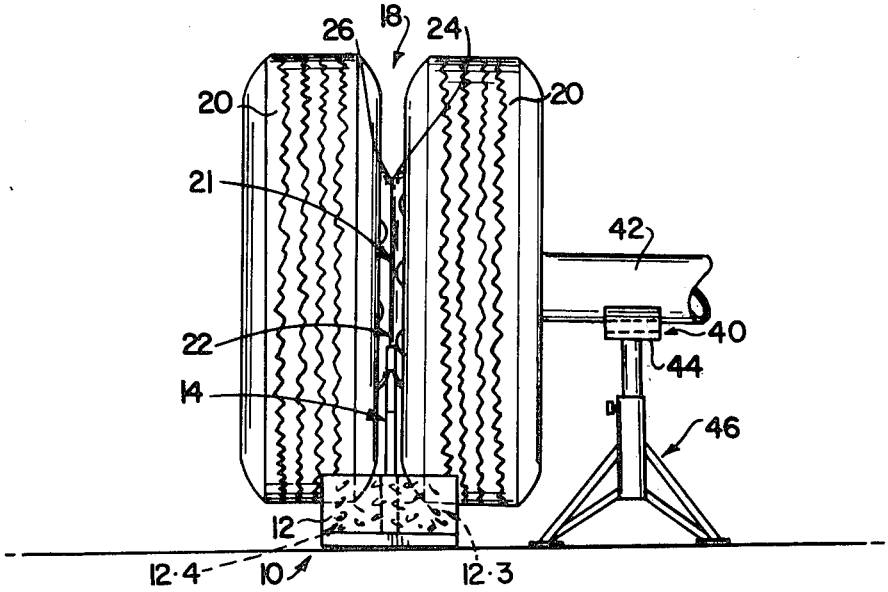
FIG. 4 shows a front view corresponding to the dotted portion of FIG. 2, i.e. after raising.

In use, when it is desired to raise wheels 20 of a vehicle having double wheels 20 as described, mounted on an axle hub 32 the jack 10, is placed in position as shown in FIGS. 2 and 3 of the drawings. Thereupon, the vehicle is displaced in the direction of arrow 36 either by pushing it or pulling it if it does not have its own motive power. Alternatively, if the wheels are power driven, then they may be driven to rotate in the direction of arrow 38. This will cause the bosses of the wheels to ride up onto the jack pole vault fashion, into a position such as shown dotted in FIG. 2, and also as shown in FIGS. 4 and 5. There will be some clearance 40 between the axle 42 and the temporary support head 44. Thereupon the securing nuts on the studs 34 will be loosened. The arcuate shape 16.2 of the upper load bearing end 16 of the strut part 14 has a converging edge and will act wedge fashion, to part the bosses 24 and 26 of the wheels as the nuts of the studs 34 are loosened. This will result in the bosses of the wheels passing downwardly on either side of the strut part 14, until the axle 42 rests on the head 44 of the temporary support 46. When this happens, the jack becomes free and the wheels may be removed, and repaired if necessary.

Figure 6:
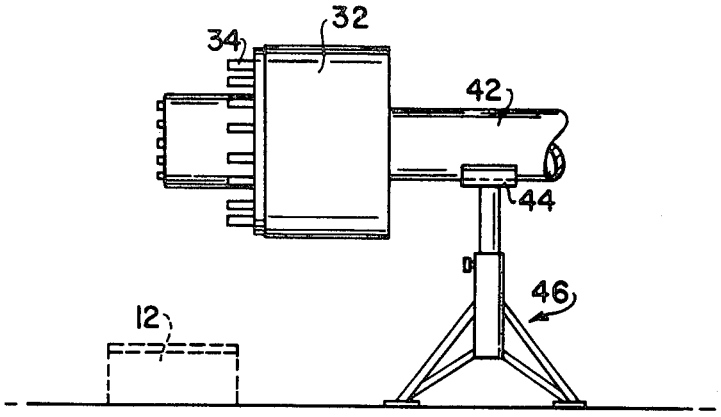
FIG. 6 shows a front view after the double wheels have been removed.

In order to replace a wheel again, the strut part 14 is removed from the socket in the base part and the base is then placed in an inverted position under the axle hub 32 as shown dotted in FIG. 6. The sloping ends 12.1 of the base part 12, will act as ramps and will permit the wheels which are to be replaced on the hub, to be rolled up the sloping ends 12.1 onto the base plate 12.11. Such wheels are usually heavy, and without the use of the ramp would present difficulty in fitting them onto the hub 32. The use of the base part 12 as a ramp, facilitates the replacement of such wheels.

While the jack has been specifically designed to raise double wheels of vehicles, it can also be utilised for the raising of single wheels, e.g. front wheels of trucks. For this purpose, the upper load bearing end of the strut, is engaged with the nuts on the securing studs of the front wheel, very much as shown in FIG. 2. A nut 34.1 is shown dotted in FIG. 2 in the position it would occupy, if the wheel there shown were a front wheel.

An insert 50 is removed from the strut part, and is then bolted onto one of the securing studs, so that it depends downwardly as indicated in dotted in FIG. 2, so as to form a latch to keep the strut part 14 in alignment during the raising operation. The base end 14.1 of the strut part, is then gripped frictionally between the walls 28 defining the socket in the base part, by the nut 52. Clearance is provided within the socket below the base end 14.1 of the strut part.

When the front wheel has been raised as shown dotted in FIG. 2, then a temporary support is placed in position under the vehicle in proximity to the wheel. Thereupon the nut 52 is loosened, thereby relaxing the frictional grip on the base end of the strut and allowing the mass of the vehicle to push the strut part into the socket until the vehicle rests on the temporary support. Once this happens the nut 52 can be released completely, thereby freeing the strut from the wheel nuts and the jack 10 may be removed. Thereupon the wheel may be removed by unscrewing the remaining nuts on the studs 34. When the wheel needs to be replaced, then the procedure described with reference to FIG. 6 may be followed.

Thus, when double wheels are to be raised, the insert 50, is used in position as shown in FIGS. 1, 2 and 5 of the drawings. However, when the jack is to be used for raising a single wheel, then the insert is removed and used as a latch. The insert 50 is located in a slot 14.2 provided in the base end 14.1 of the strut part. The insert is required when the load to be taken by the jack, is substantial such as for raising double wheels, and when it is more than can be taken by the jack when the strut part at the base end is gripped frictionally by means of the bolt and nut 52.

The insert 50 also provides adjustment in the overall height or effective length of the jack. When the insert 50 is in position in the slot 14.2, as shown in FIGS. 1, 2, and 5 of the drawings, it supports the strut 14 in an extended position relative to the base part 12. In this position, the base end 14.1 of the strut part 14 is clear of the bottom of the socket 28.1, and the top of the slot 14.2 sits saddle-fashion on the insert 50. The insert 50 is held in position by the bolt with its nut 52 engaging with the insert 50 and with holes in the walls 28 defining the socket 28.1.

When it is desired to shorten the overall length of the jack, then the insert 50 is removed and the base end 14.1 of the strut 14 can rest in the bottom of the socket 28.1. Alternatively, the base end 14.1 of the strut 14 may be gripped frictionally by the bolt and nut 52, urging the walls 28 together. When so gripped, the base end 14.1 may be a desired distance above the bottom of the socket 28.1, to provide a desired length of jack.

The hole 17 in the strut part and the hole 13 in the base part are used for bolting these parts against the chassis of the vehicle. If desired the bolt may be provided with a suitable lock.

The base part 12 extends laterally to substantially the same extent on either side of the walls 28 defining the socket 28.1. (See FIGS. 4 and 5). The base part 12 has recesses 12.3 and 12.4 on either side of the walls 28. The recesses are of sufficient dimensions so that when the jack 10 is in use, they can accommodate the tyres of the wheels 20.

The applicant has found, suprisingly, that a strut part, when made of plate which is thin enough to pass into the clearance space between a pair of double wheels, is nonetheless strong enough to raise a heavy vehicle without buckling.

I claim:

1. A method of jacking up of a road vehicle having a pair of double wheels, of the kind described;

the method including the steps of providing a jack comprising a base, and a strut adapted to pass into the clearance space between the wheels, the strut having an upper load bearing end;

locating the jack in a position such that the base rests against the ground, such that the strut is at a slope in the clearance space between the wheels, and such that the upper load bearing end engages simultaneously with the bosses of both wheels along an engagement zone; and then moving the vehicle against the strut to cause the wheels to ride up onto the strut in polevault fashion, to lift the wheels clear of the ground.

2. A method as claimed in claim 1, in which the load bearing end of the strut is of concave arcuate shape which seats in the circumferential notch when the upper load bearing end of the strut is in engagement with the bosses in the engagement zone.

3. A method as claimed in claim 2, in which the arcuate shape of the upper load bearing end of the strut converges in cross section towards the end, the bosses seating in the arcuate shape, and the convergent cross section of the arcuate shape fitting into the notch in the engagement zone; and in which the said load bearing end under load is adapted to act wedge fashion to part the bosses of the wheels when the securing screws or nuts on the studs are loosened.

4. A method as claimed in claim 1, in which the base is temporarily tied to one of the wheels.

5. A method as claimed in claim 1, in which the effective length of the strut is from 50 to 150 mm longer than the radial distance between the engagement zone and the outer periphery of the wheels.

6. A method as claimed in claim 5, in which the base is detachable from the strut, and is of ramp formation having an overall height which is about equal to the length by which the effective length of the strut exceeds the radial distance between the engagement zone and the outer periphery of the wheels.

7. A method of removing the double wheels of a road vehicle from an axle hub of the vehicle, which method includes (a) jacking up the wheels according to the method as claimed in claim 1;

(b) placing a temporary support under the vehicle at a region in proximity to the said wheels;

(c) loosening the securing screws or nuts to permit the abutting bosses of the wheels to come apart and to pass under gravity on either side of the load bearing end of the strut, thereby permitting the vehicle to rest on the temporary support; and thereafter (d) loosening the wheels from the axle hub and removing them.

8. A method as claimed in claim 7, in which the vertical clearance space between the temporary support and the vehicle is less than the radial spacing between the engagement zone and the securing bolts or studs for holding the wheel bosses.

9. A jack adapted for use in jacking up a road vehicle having a pair of double wheels of the kind described, the wheels having limited axial clearance space between them, the jack comprising: a base part and a separable strut part extending upwardly from the base part, the strut part being a flat metal plate having a thickness of at least 10 mm and having a base end that is at least ten times as wide as it is thick and a load bearing end that is adapted to pass into the axial clearance space between the double wheels and seat in the circumferential notch defined between the abutting bosses of the double wheels, the base part being wider than the axial clearance space between the double wheels and having walls defining a socket adapted to accommodate the base end of the strut part, the base part engaging the ground and the strut part being at an angle to the ground prior to lifting said double wheels off the ground.

10. A jack adapted for use in jacking up a road vehicle having a pair of double wheels of the kind described, the wheels having limited axial clearance space between them, the jack comprising: a base part and a separable strut part extending upwardly from the base part, said base part and said strut part when in use being adapted to lie at a slope with the base part engaging the ground, the strut part having a base end and a load bearing end which is adapted to pass into the axial clearance space between the double wheels and seat in the circumferential notch defined between the abutting bosses of the double wheels, the base part being in the form of an inverted double ramp having a base plate and a pair of upwardly sloping end plates, the widths of which are greater than the axial clearance space between the double wheels, and a pair of longitudinal transversely spaced wall plates joining the base plate and the end plates and defining a socket extending across the base plate between the sloping end plates, said socket being generally rectangular in cross-section and accomodating the base end of the strut part, the overall thickness across the wall plates being at the most such that they will pass into the clearance space between the tires of the wheels when the jack is in use.

11. A jack adapted for use in jacking up a road vehicle having a pair of double wheels of the kind described, the jack comprising a base part and a strut part extending upwardly from the base part, the struct part having a load bearing end adapted to pass into the axial clearance space between the double wheels and to engage simultaneously along an engagement zone with the abutting bosses of the double wheels, and being adapted in use to lie at a slope such that the base part engages with the ground; the strut part and the base part being separable, the strut part having a base end and the base part having walls defining a socket to accommodate the base end of the strut part, and the base part extending laterally to substantially the same extent on either side of the socket, the base part having a recess on either side of the walls defining the socket, and the recesses being of sufficient dimensions so that when the jack is in use, they can accommodate the tires of the wheels.

12. A jack as claimed in claim 11, in which the socket is rectangular in cross-section, having a length which is at least ten times its width, and having a depth at least five times its width.

13. A jack adapted for use in jacking up a road vehicle having a pair of double wheels of the kind described, the wheels having limited axial clearance space between them, the jack comprising: a base part and a separable strut part extending upwardly from the base part, said base part and said strut part when in use being adapted to lie at a slope such that with the base part engages the ground, the strut part having a base end and a load bearing end which is adapted to pass into the axial clearance space between the double wheels and seat in the circumferential notch defined between the abutting bosses of the double wheels, the base part being in the form of an inverted double ramp having a base plate and a pair of upwardly sloping ends, and a pair of longitudinal wall plates defining a socket extending between the sloping ends and across the base plate and accommodating the base end of the strut part.

14. A jack as claimed in claim 13, in which the base part extends laterally to substantially the same extent on either side of the socket, the base part having a recess on either side of the walls defining the socket, the recesses being of sufficient dimensions so that when the jack is in use, they can accommodate the tires of the wheels.

15. A jack as claimed in claim 13, in which the base part and the strut parts are separable and in which the base part is in the form of an inverted ramp having sloping ends with a flat part between the sloping ends, the base part when inverted and when the strut part is separated from it being adapted to act as a ramp to permit a wheel to roll up either of the two sloping ends onto the flat part.

16. A jack as claimed in claim 15 or claim 13, in which the depth of the socket corresponds substantially to the height of the ramp.

17. A jack as claimed in claim 9 or claim 15, in which the effective length of the jack is adjustable by varying the degree of engagement between the strut part and the base part by having a removable insert co-acting between the base part and the strut part.

* * * * *